US009644510B2

(12) United States Patent
Hörr et al.

(10) Patent No.: US 9,644,510 B2
(45) Date of Patent: May 9, 2017

(54) EXHAUST PIPE

(71) Applicant: Eberspächer Exhaust Technology GmbH & Co. KG, Neunkirchen (DE)

(72) Inventors: Micha Hörr, Schorndorf (DE); Peter Gorke, Stuttgart (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 14/965,147

(22) Filed: Dec. 10, 2015

(65) Prior Publication Data

US 2016/0169070 A1 Jun. 16, 2016

(30) Foreign Application Priority Data

Dec. 12, 2014 (DE) ..... 10 2014 225 749

(51) Int. Cl.

| | |
|---|---|
| ***F01N 1/02*** | (2006.01) |
| ***F01N 13/08*** | (2010.01) |
| ***F01N 1/24*** | (2006.01) |
| ***F01N 13/18*** | (2010.01) |
| ***F01N 1/04*** | (2006.01) |

(52) U.S. Cl.

CPC ..... *F01N 1/24* (2013.01); *F01N 1/04* (2013.01); *F01N 13/08* (2013.01); *F01N 13/1805* (2013.01); *F01N 13/1894* (2013.01); *F01N 1/02* (2013.01); *F01N 1/026* (2013.01); *F01N 2310/04* (2013.01); *F01N 2470/02* (2013.01); *F01N 2490/14* (2013.01); *F01N 2490/15* (2013.01); *F01N 2490/155* (2013.01)

(58) Field of Classification Search

CPC ..... F01N 1/026; F01N 13/08; F01N 13/1805; F01N 13/1894

USPC ..... 181/227, 228, 229, 250, 266, 273, 276, 181/282

See application file for complete search history.

(56) References Cited

U.S. PATENT DOCUMENTS 3,146,850 A * 9/1964 Ludlow ..... F01N 1/006 138/37
RE25,909 E * 11/1965 Ludlow ..... F01N 1/02 181/227
3,263,772 A * 8/1966 Irwin ..... F01N 1/02 181/227

(Continued)

FOREIGN PATENT DOCUMENTS

DE 10 2008 005 446 A1 7/2009
EP 0 120 181 A1 10/1984

(Continued)

OTHER PUBLICATIONS

Tranlsation of JP 2012-122402 A, <http://translationportal.epo.org/emtp/translate/?ACTION=description-retrieval&COUNTRY=JP&ENGINE=google&FORMAT=docdb&KIND=A&LOCALE=en_EP&NUMBER=2012122402&OPS=ops.epo.org/3.1&SRCLANG=ja&TRGLANG=en>; accessed Aug. 23, 2016.*

*Primary Examiner* — Jeremy Luks
(74) *Attorney, Agent, or Firm* — McGlew and Tuttle, P.C.

(57) ABSTRACT

A pipe (11), carrying exhaust gas, of an exhaust system (1) of an internal combustion engine (9), with a tubular body (15) carrying exhaust gas, and with at least one attachment part (12) separate with respect to the tubular body (15), which is added laterally to the tubular body (15) so that externally on the tubular body (15) a cavity (13) is arranged delimited at least partially by the attachment part (12), which extends in the circumferential direction (14) of the tubular body (15) over less than 360°.

17 Claims, 3 Drawing Sheets

(56) References Cited

U.S. PATENT DOCUMENTS

| | | | | | |
|---|---|---|---|---|---|
| 3,648,803 | A * | 3/1972 | Heath | F01N 1/006 | 181/250 |
| 4,719,988 | A * | 1/1988 | Kinouchi | F01N 1/003 | 181/265 |
| 5,349,141 | A * | 9/1994 | Horibe | F02M 35/1266 | 181/224 |
| 8,316,987 | B2 * | 11/2012 | Ishida | F01N 1/04 | 181/229 |
| 2010/0193284 | A1 * | 8/2010 | Zheng | F01N 1/003 | 181/276 |
| 2011/0186373 | A1 | 8/2011 | Mori et al. | | |
| 2012/0186905 | A1 | 7/2012 | Matsushima et al. | | |

FOREIGN PATENT DOCUMENTS

| | | | | |
|---|---|---|---|---|
| EP | 2 514 941 | A1 | | 10/2012 |
| JP | 03210018 | A | * | 9/1991 |
| JP | H05-214 930 | A | | 8/1993 |
| JP | 2012-122 402 | A | | 6/2012 |

* cited by examiner

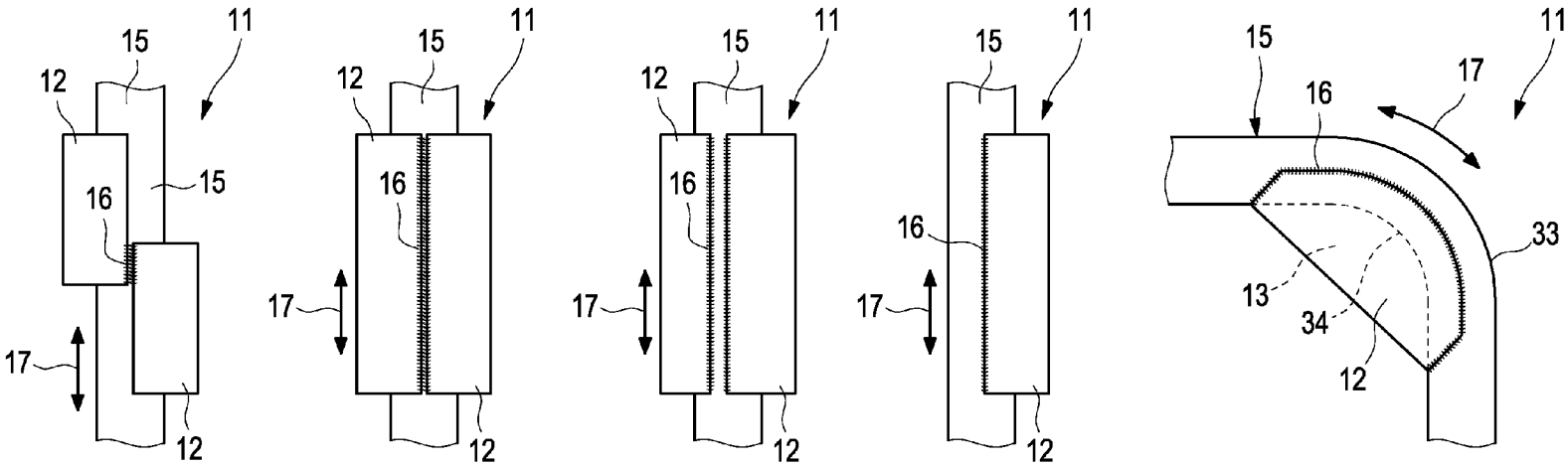
Fig. 5a
Fig. 5b
Fig. 5c
Fig. 5d
Fig. 5e
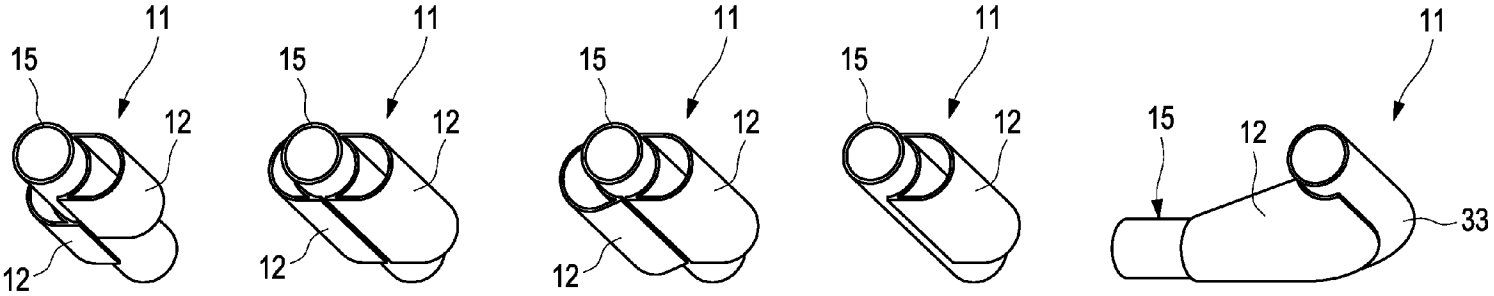
Fig. 6a
Fig. 6b
Fig. 6c
Fig. 6d
Fig. 6e

EXHAUST PIPE

CROSS REFERENCE TO RELATED APPLICATIONS

This application claims the benefit of priority under 35 U.S.C. §119 of German Patent Application 10 2014 225 749.2 filed Dec. 12, 2014, the entire contents of which are incorporated herein by reference.

FIELD OF THE INVENTION

The present invention relates to a pipe carrying exhaust gas of an exhaust system of an internal combustion engine. The invention furthermore relates to an exhaust system which is equipped with at least one such pipe.

BACKGROUND OF THE INVENTION

An exhaust system, which serves for the discharging of combustion exhaust gases from an internal combustion engine fulfils several functions. The most important functions here are, on the one hand, the carrying out of an exhaust gas aftertreatment, in order to reduce the pollutant emissions of the internal combustion engine. On the other hand, the exhaust system effects an intensive sound absorption, in order to reduce the noise emissions of the internal combustion engine. Sound absorbers with a small damping volume can be positioned here virtually as desired along the exhaust system, and can be connected acoustically with a pipe, carrying exhaust gas, of the exhaust system. For example, a tubular housing of such a sound absorber can be arranged concentrically to such an exhaust pipe and can be connected therewith via terminal plates on the face side. A perforation in the exhaust pipe then leads to the acoustic coupling between the exhaust system, i.e. the interior of the exhaust pipe and a damping chamber formed in the housing, which surrounds the exhaust pipe in an annular manner. A problem in such simple sound absorbers, however, is the different thermal load of the exhaust pipe on the one hand, and of the tubular housing on the other hand. Generally, the exhaust pipe is exposed to distinctly higher temperature fluctuations than the housing, so that the connection sites between housing and exhaust pipe, which are situated on the terminal plates of the housing on the face side, are exposed to high thermal alternating loads. To solve this problem, it is basically conceivable to interrupt the exhaust pipe within the housing, i.e. between two terminal plates which fix the housing on the exhaust pipe, or to equip it with a sliding seat, so that ultimately the housing is held movably relative to the exhaust pipe in the longitudinal direction of the exhaust pipe. However, such a structural shape is comparatively cost intensive. In addition, problems can occur with regard to gas tightness.

The exhaust pipes used in the exhaust system can, in addition, contribute to the stability of the exhaust system, for example when via such an exhaust pipe two relatively heavy components of the exhaust system have to be connected to one another.

SUMMARY OF THE INVENTION

The present invention is concerned with the problem of indicating for a pipe of the above-mentioned type, carrying exhaust gas, or respectively for an exhaust system equipped therewith, an improved embodiment which is distinguished in particular by an additional function. In particular, according to one aspect of the invention, an increased dimensional stability or respectively rigidity for the exhaust pipe is aimed for. According to a further aspect of the invention, a particularly economically priced producibility of a sound absorber can be desired. As an additional aspect, in addition, a compact structural form for the exhaust pipe with a sound absorber function can be aimed for.

The invention is based on the general idea of equipping the pipe carrying exhaust gas, which is also designated below as the exhaust pipe, with an attachment part, produced separately with respect to a tubular body of the exhaust pipe, wherein the attachment part is added externally onto the tubular body such that externally on the tubular body a cavity is produced, which is entirely or partially delimited by the attachment part. Furthermore, the attachment part and the tubular body are coordinated with one another such that the attachment part extends in the circumferential direction of the tubular body over less than 360° and preferably over 180° or over less than 180°. Through the arranging of the attachment part on the tubular body, the exhaust pipe is reinforced in the region of the attachment part. As the attachment part is configured or respectively is arranged on the tubular body such that a cavity forms additionally to the interior of the tubular body carrying exhaust gas, an increased area moment of inertia occurs transversely to the longitudinal direction of the tubular body, which significantly increases the rigidity of the exhaust pipe. The provision of the cavity additionally opens up the possibility of using the cavity as a sound-damping chamber, whereby the exhaust pipe can be modified to a sound absorber. Such a sound absorber can be realized in a comparatively inexpensive manner, because substantially only the attachment part has to be mounted on the tubular body of the exhaust pipe. The arrangement of the attachment part on the exhaust pipe, such that the attachment part extends at a maximum over half of the circumference of the tubular body leads in addition to an extremely compact structural shape, so that the exhaust pipe which is presented here can be realized virtually at any desired location of the exhaust system between its start, which is generally formed by an exhaust manifold, and its end, which is generally formed by a tailpipe.

For example, provision can therefore be made that the cavity is closed toward the exterior. In addition, provision can be made that the cavity is connected fluidically and/or acoustically to an interior of the tubular body. Furthermore, provision can be made optionally that the cavity is filled with a sound-absorbing material.

According to an advantageous embodiment, the attachment part can be fastened on the tubular body on two sides of the tubular body facing away from one another. The attachment part extends here along the longitudinal direction of the tubular body, so that the fastening of the attachment part on the tubular body also takes place in the cross-section of the tubular body on two opposite sides and preferably on two sides lying diametrically opposite one another. Through the direct coupling of the attachment part with the tubular body, in particular a good thermal coupling is achieved between attachment part and tubular body, so that the temperature difference between tubular body and attachment part is reduced. As a result, thermally-caused stresses between attachment part and tubular body are also reduced.

According to a particularly advantageous further development, the attachment part can be fastened on the respective side of the tubular body by means of a welded connection, which extends along the tubular body in the longitudinal extent direction of the tubular body. As the fixing between attachment part and tubular body therefore takes place along the longitudinal direction of the tubular body, thermally-caused expansion differences lead only over comparatively small stresses within the weld seam, because the latter is only stressed in its longitudinal direction. An embodiment is advantageous in which the respective welded connection extends over the entire length of the attachment part. Hereby, the thermal alternating load of the respective weld seam is minimized.

In another advantageous embodiment, the attachment part can be a shell body produced from one piece, which transversely to a longitudinal extent of the tubular body, carrying exhaust gas, has a U-shaped cross-section and two legs, connected via a curve, which are fastened on opposite sides of the tubular body. The configuration of the attachment part as a shell body enables the attachment part and the exhaust pipe equipped therewith to be realized particularly economically. The cavity is then delimited on the one hand by an inner wall of the attachment part and on the other hand by an outer wall of the tubular body.

According to an advantageous further development, the tubular body can be perforated in the region of the attachment part. Such a perforation can be basically configured in any desired manner, for example by a single wall opening or preferably by a plurality of comparatively smaller wall openings. By the perforation, an acoustic coupling of the pipe interior with the cavity takes place, whereby the cavity can be used as a sound-damping chamber. For example, the cavity serves as an expansion chamber or as an absorption chamber. With targeted coordination of the perforation or respectively of the openings of the perforation, a kind of Helmholtz resonator can also be realized, the resonance volume of which is delimited by the cavity and the vibration volume of which is formed within the openings of the perforation. Basically, a "genuine" Helmholtz resonator can also be realized, if in a suitable manner a so-called "neck" is provided, which contains the vibratory volume. For example, such a neck of the Helmholtz resonator can be produced by a branch pipe branching off from the tubular body within the attachment part, by a corresponding geometry of the attachment part or by a protrusion or a tulip shaping of the tubular body in the production of a wall opening in the tubular body. Likewise, a sound damping can be realized by means of microperforation, when the openings of the perforation have an opening cross-section of a maximum of 1 mm.

In an alternative embodiment, the attachment part can be a further or other tubular body produced from one piece, which has a connection side which is shaped in a complementary manner to an outer wall of the tubular body carrying exhaust gas, onto which the additional tubular body is added, so that the connection side contacts the outer wall in a planar manner (facing contact or planar contact). Through the planar contact between the outer side and the outer wall, an intensive heat transmission can be realized between attachment part and tubular body, which reduces thermally-caused stresses owing to temperature differences. In this structural form, the cavity is delimited at least in the cross-section of the exhaust pipe exclusively by an inner side of the attachment part. This enables a shaping for the cavity independently of the tubular body carrying exhaust gas.

According to an advantageous further development, the connection side of the attachment part and the outer wall of the tubular body carrying exhaust gas can be perforated in the region of the contact between connection side and outer wall. Also, hereby, an acoustic coupling is created between the interior of the tubular body which is flowed through by exhaust gas and the cavity of the attachment part which is not flowed through, in order to realize a sound absorption function. The perforations of connection side and outer wall can basically be configured identically. Likewise, it is possible to configure the perforations differently. For example, the outer wall of the pipe can be formed with a perforation formed from several openings, whereas the connection side has a perforation which is formed by a single opening, which extends over all the openings of the perforation of the outer wall. Also, a reversed structural form is conceivable.

According to another advantageous embodiment, the cavity can be closed in the longitudinal extent of the tubular body at each end by a closure element. Such a closure at the longitudinal ends of the cavity is necessary especially when the respective cavity is coupled acoustically and ultimately also fluidically to the interior of the tubular body. The respective closure element can basically represent a separate component with respect to the attachment part, which separate component is fastened to the attachment part in a suitable manner. Likewise, the respective closure element may be formed integrally on the attachment part. Furthermore the respective closure element may be fastened on the tubular body. At least one such closure element may be formed integrally on the tubular body.

The tubular body carrying exhaust gas can basically have any desired spatial longitudinal extent. For example, it can extend in a curved shape or in a straight line.

In so far as the tubular body extends in a straight line or has a straight-lined at least two such attachment parts may be arranged on the tubular body, which are arranged in the circumferential direction of the tubular body and/or in the longitudinal direction of the tubular body offset to one another on the tubular body. In this way, the installation space available along the exhaust system can be utilized particularly favourably, in order to provide a reinforcement and/or a sound absorption function by arranging several such attachment parts on the respective exhaust pipe.

In another advantageous embodiment, the tubular body can extend in a curved manner, so that it has a curve. Expediently, the attachment part is then arranged on the tubular body on an inner side of the curve. In this way, a particularly efficient reinforcement of the curved tubular body is produced in the region of the curve.

According to a further development, the attachment part can be shaped so that the cavity is also closed in the longitudinal extent of the tubular body at each end by the tubular body itself, even when no additional closure elements are formed for this on the attachment part. In this case, the attachment part is adapted to the curvature or respectively to the curve of the tubular body so that the cavity is closed on all sides when the attachment part is placed onto the tubular body. This measure also simplifies the production of the exhaust pipe with attachment part and cavity, which is presented here.

This embodiment can be combined particularly well with the embodiment described further above, in which the attachment part is a shell body produced from one piece, which transversely to a longitudinal extent of the tubular body has a U-shaped cross-section with two legs connected via a curve, which legs are fastened on opposite sides of the tubular body. A configuration is particularly advantageous here in which the two legs are curved respectively at their edge remote from the curve of the shell body in accordance with the curve of the tubular body. As then, in addition, the weld seam, which is present if applicable, follows this edge, a significant reinforcing of the tubular body is produced in the region of its curve.

An exhaust system according to the invention comprises at least one exhaust gas aftertreatment device, which can be configured for example as a catalytic converter or as a particle filter or as a sound absorber or as any desired combination of such components. In any case, the exhaust gas aftertreatment device or respectively its housing is connected on the inlet side and on the outlet side respectively to a pipe section carrying exhaust gas. In the exhaust system according to the invention, at least one such pipe section is now formed by an exhaust pipe of the type described above, which is distinguished by an additional function, namely by an increased rigidity and optionally by a sound absorption function.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 5*a* is a side view of an exhaust pipe showing one of different embodiments;

FIG. 5*b* is a side view of an exhaust pipe showing another of different embodiments;

FIG. 5*c* is a side view of an exhaust pipe showing another of different embodiments;

FIG. 5*d* is a side view of an exhaust pipe showing another of different embodiments;

FIG. 5*e* is a side view of an exhaust pipe showing another of different embodiments;

FIG. 6*a* is an isometric view of the exhaust pipe of the embodiment of FIG. 5*a;*

FIG. 6*b* is an isometric view of the exhaust pipe of the embodiment of FIG. 5*b;*

FIG. 6*c* is an isometric view of the exhaust pipe of the embodiment of FIG. 5*c;*

FIG. 6*d* is an isometric view of the exhaust pipe of the embodiment of FIG. 5*d*; and FIG. 6*e* is an isometric view of the exhaust pipe of the embodiment of FIG. 5*e*.

DESCRIPTION OF THE PREFERRED EMBODIMENTS

Figure 1:
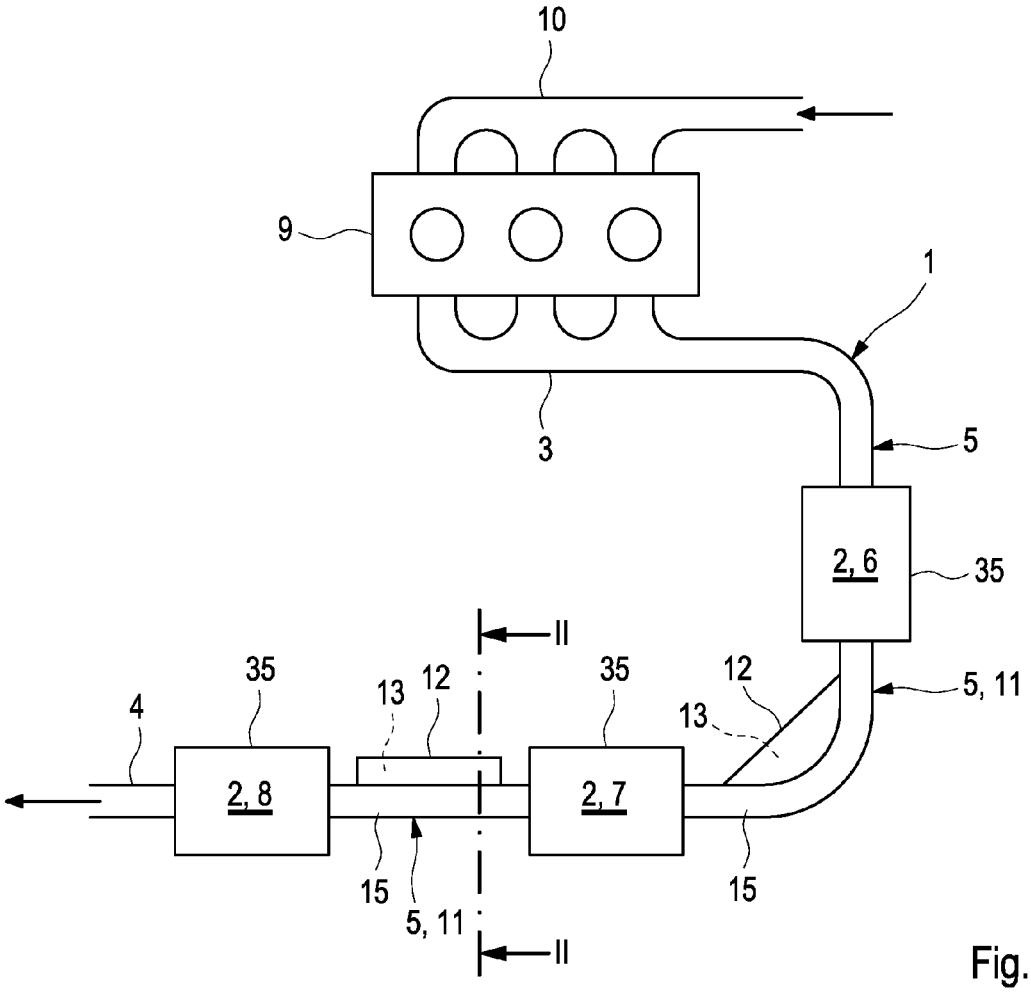
FIG. 1 is a greatly simplified schematic diagram, in the manner of a circuit diagram, of an exhaust system with a plurality of exhaust pipes.

According to FIG. 1, an exhaust system 1 comprises a plurality of exhaust gas aftertreatment devices 2, an exhaust manifold 3 on the inlet side and a tailpipe 4 at the outlet side. In addition, the exhaust system 1 has a plurality of pipe sections 5, for example in order to connect two exhaust gas aftertreatment devices 2 with one another or in order to connect the exhaust manifold 3 with such an exhaust gas aftertreatment device 2. The exhaust gas aftertreatment devices 2 can be, for example, a catalytic converter 6, a particle filter 7 and a sound absorber 8. Expediently here respectively a housing 35 of the respectively exhaust gas aftertreatment device 2 is connected on the inlet side and/or on the outlet side to such a pipe section 5. In the example of FIG. 1, the tailpipe 4 is connected directly onto the sound absorber 8.

The exhaust system 1 serves for the discharging of combustion exhaust gases from an internal combustion engine 9, which is equipped in addition with a fresh air system 10 for the fresh air supply. Expediently, the internal combustion engine 9, exhaust system 1 and fresh air system 10 are arranged in a motor vehicle, which is not illustrated further here.

In the example of FIG. 1, two of the pipe sections 5 as pipe 11 carrying exhaust gas, which can also be designated below as exhaust pipe 11, are configured as follows. According to FIGS. 1 to 6, such an exhaust pipe 11 comprises a pipe section 15, which in operation of the exhaust system 1 serves for carrying a stream of exhaust gas, and an attachment part 12, which in operation of the exhaust system 1 is not flowed through by exhaust gas, which is a separate component with respect to the tubular body 15 and which is added to the tubular body 15. Here, a geometry of the attachment part 12 and its arrangement on the tubular body 14 are coordinated with one another so that externally on the tubular body 15 a cavity 13 is produced, which is delimited at least partially by the attachment part 12.

As can be seen in particular from FIGS. 2 to 6, the attachment part 12 and the cavity 13 do not extend completely in a circumferential direction 14 of the tubular body 15, i.e. over less than 360° and preferably over a maximum of 180° along the tubular body 15 of the exhaust pipe 11. The tubular body 15 fulfils the exhaust gas carrying function of the exhaust pipe 11 and can therefore also be designated as a tubular body 15 which is flowed through or which carries exhaust gas.

Figure 2:
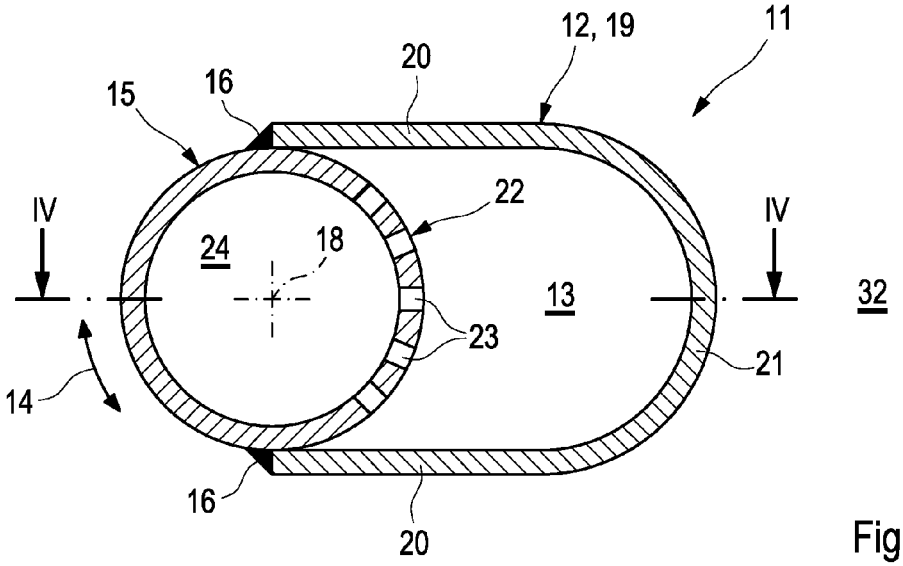
FIG. 2 is a greatly simplified cross-section of an exhaust pipe, according to section lines II in FIG. 1.
Figure 3:
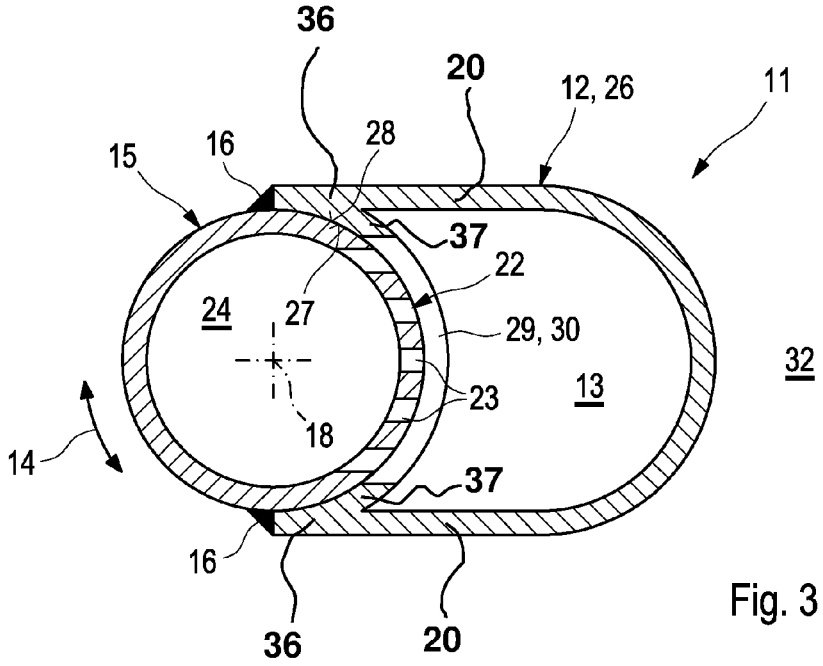
FIG. 3 is a cross-sectional view, similar to FIG. 2, but showing another embodiment.

As can be seen in particular from FIGS. 2 and 3, the attachment part 12 is fastened on the tubular body 15 on two sides of the tubular body 15 facing away from one another. In FIGS. 2 and 3 respectively two weld seams 16 can be observed, which fix the attachment part 12 on the tubular body 15. It is particularly advantageous here if the respective weld seam 16, which can also be generally designated as welded connection 16, extends along the tubular body 15 in a longitudinal direction 17 or longitudinal extent 17 of the tubular body 15. The longitudinal direction 17 or respectively the longitudinal extent 17 of the tubular body 15 follows here a longitudinal center axis 18 of the tubular body 15, which can be straight-lined according to the examples of FIGS. 4 and 5*a* to 5*d* and 6*a* to 6*d*, or can be curved according to the example of FIGS. 5*e* and 6*e*. In particular, the respective welded connection 16 can extend over the entire length of the attachment part 12 in the longitudinal direction 17 along the tubular body 15.

Figure 4:
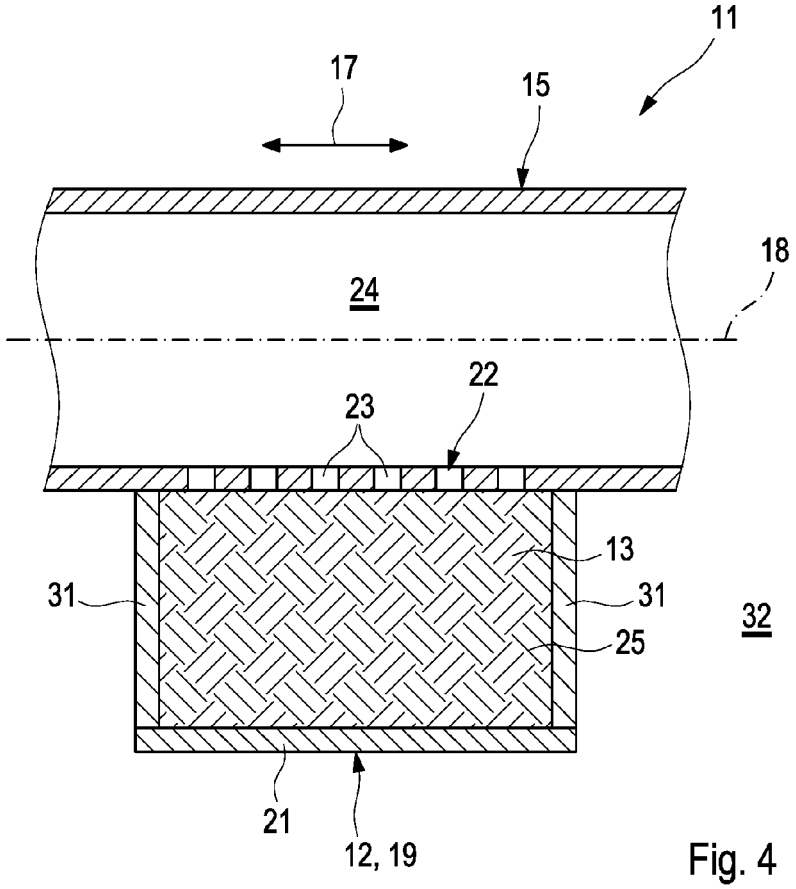
FIG. 4 is a longitudinal sectional view of the exhaust pipe according to section lines IV in FIG. 2.

According to the embodiment shown in FIGS. 2 and 4, the attachment part 12 can be a shell body 19, which is produced in one piece, i.e. from one piece. The shell body 19 is equipped here with a substantially U-shaped cross-section transversely to the longitudinal extent 17 of the tubular body 15, in which two legs 20 are connected with one another via a curve 21. The legs 20, lying opposite one another, are fastened at opposite sides of the tubular body 15. In addition, in the preferred example which is shown here, the tubular body 15 is perforated in the region of the attachment part 12, i.e. is equipped with a perforation 22, which purely by way of example is formed by a plurality of separate openings 23. Hereby, an interior 24 of the tubular body 15 is coupled acoustically and ultimately also fluidically with the cavity 13. The cavity 13 is not flowed through by the exhaust gas here. The cavity 13 therefore serves as a sound damping chamber, e.g. as an absorption chamber or as a reflection chamber. According to FIG. 4, a sound-absorbing material 25, e.g. metal wool or suchlike, can be arranged in the cavity 13.

According to FIG. 3, the attachment part 12, instead of being configured as a shell body 19, can alternatively be configured as a further tubular body 26, which is likewise expediently produced from one piece or respectively in one piece. This further tubular body 26, in contrast to the tubular body 15 carrying exhaust gas, is not flowed through by exhaust gas and has a connection portion formed of sections 36 and 37 with a connection side 27, which is shaped in a complementary manner to an outer wall 28 of the tubular body 15 carrying exhaust gas. As shown in FIG. 3, the connection sections 36 and 37 extend from the respective leg 20 in opposite circumferential directions of the tubular body 15. With this complementary connection side 27, the further tubular body 26 is added to the outer wall 28 of the exhaust pipe tubular body 15, such that the connection side 27 lies in planar manner against the outer wall 28. Hereby, an intensive heat transmission is achieved between the tubular body 15 carrying exhaust gas and the further tubular body 26 of the attachment part 12. In the example of FIG. 3 a sound absorption function for the exhaust pipe 11 is also provided. For this, the connection side 27 and the outer wall 28 are perforated in the region of the contact between outer side 27 and the outer wall 28. By way of example, the tubular body 15 carrying exhaust gas is again equipped with a perforation 22, which is formed by a plurality of openings 23. In contrast thereto, a perforation 29 of the further tubular body 26 is formed purely by way of example by a single opening 30, which covers the entire region of the perforation 22 of the tubular body 15 carrying exhaust gas. Likewise such a window-like opening may be provided in the tubular body 15 carrying exhaust gas, whilst then the further tubular body 26 has a perforation formed by a plurality of openings. The previously mentioned variant is, however, preferred, owing to the reduced flow resistances. Here, also, through the perforations 22, 29 an acoustic and ultimately also fluidic coupling is created between the cavity 13 and the interior 24.

According to FIG. 4, the cavity 13 can be closed in the longitudinal extent 17 of the pipe 11 or respectively of the tubular body 15 carrying exhaust gas at each of its longitudinal ends or face-side ends respectively by a closure element 31. Hereby, the shaping for the attachment part 12 is simplified. In so far as no perforation 22 is provided, such closure elements 31 are basically not necessary in order to achieve the desired reinforcing of the tubular body 15 carrying exhaust gas or respectively of the exhaust pipe 11. If, however, the cavity 13 is to be used for sound absorption, the cavity 13 must be closed tightly on all sides, apart from the region of the perforation 22. In the example of FIG. 4, the two closure elements 31 are designed both with regard to the tubular body 15 carrying exhaust gas and also with regard to the attachment part 12 as separate components, which are added both to the attachment part 12 and also to the tubular body 15. However, corresponding welded connections or weld seams are not illustrated here. The respective closure elements 31 may be formed integrally on the tubular body 15 or integrally on the attachment part 12.

With reference to FIGS. 5*a*-5*e* and 6*a*-6*e*, further basic features for other embodiments are now discussed, wherein the features explained below can basically also be combined arbitrarily with the features of the embodiments explained above.

According to the variants of FIGS. 5*a*, 6*a* and 5*d* and 6*d*, the exhaust pipe 11 is, as a whole, straight-lined. The tubular body 15 therefore extends in a straight manner. In the embodiments of FIGS. 5*a*, 6*a* and 5*c* and 6*c*, respectively two attachment parts 12 are added to the tubular body 15. In the embodiment of FIGS. 5*a* and 6*a*, the two attachment parts 12 are arranged offset to one another on the tubular body 15 in the longitudinal direction 17 of the tubular body 15. In the variants of FIGS. 5*a*, 6*a* and 5*b*, 6*b*, the two attachment parts 12 are arranged lying diametrically opposite, i.e. offset to one another by 180° in the circumferential direction 14, on the tubular body 15. This makes it possible, in particular, to fix the two attachment parts 12 on the tubular body 15 via shared weld seams 16.

In the embodiments shown in FIGS. 5*a*, 6*a*; 5*b*, 6*b*; and 5*c*, 6*c*, the attachment parts 12 are respectively dimensioned to be of equal size in the longitudinal direction 17. The two attachment parts 12 may also be dimensioned unequally.

The embodiment of FIGS. 5*c* and 6*c* differs from the embodiment of FIGS. 5*b* and 6*b* in that the two attachment parts 12 do not lie precisely diametrically opposite one another, but rather are aligned to one another in an angle different from 180°. This can be advantageous for the adapting of the exhaust pipe 11 to special installation situations.

As explained, the attachment parts 12 can be arranged on the tubular body 15 exclusively for reinforcement purposes. This reinforcement proves to be particularly efficient when by means of the attachment part 12 said cavity 13 is created outside the tubular body 15 carrying exhaust gas, because thereby the area moment of inertia of the entire exhaust pipe 11 increases significantly. However, the embodiment is preferred in which the cavity 13 is used as a sound absorption chamber, so that an acoustic coupling exists between the interior 24 of the tubular body 15 and the cavity 13. For this, the cavity 13 must be tight with respect to an environment 32 of the exhaust pipe 11. As explained above with regard to FIG. 4, the closure elements 31 can be provided for this. These closure elements 31, however, are not illustrated in FIGS. 6*a* to 6*d*.

According to the variant of FIGS. 5*e* and 6*e*, the exhaust pipe 11 or respectively the exhaust pipe tubular body 15 can extend in a curved manner, so that the tubular body 15 has a curve 33. The attachment part 12 is in this case preferably arranged on an inner side 34 of the curve 33 on the tubular body 15. Hereby, the curved pipe 11 can be reinforced particularly efficiently. In addition, the attachment part 12 according to FIGS. 5*e* and 6*e* can be respectively shaped in a targeted manner so that the cavity 13 at its longitudinal ends is closed respectively directly by the tubular body 15. This can be realized particularly simply when the attachment part 12 is configured as a shell body 19. Separate or additional closure elements 31 can therefore be dispensed with. As can be seen, in this side view the two legs 20 of the U-shaped shell body 19 then respectively have an edge remote from the straight curve 21 of the shell body 19, along which the weld seam 16 extends. This edge has here a curvature which corresponds to the curvature of the curve 33 of the tubular body 15, i.e. has substantially the same radius of curvature.

While specific embodiments of the invention have been shown and described in detail to illustrate the application of the principles of the invention, it will be understood that the invention may be embodied otherwise without departing from such principles.

What is claimed is:

1. An exhaust gas carrying pipe of an exhaust system of an internal combustion engine, the exhaust gas carrying pipe comprising:

a tubular body carrying exhaust gas; and an attachment part separate with respect to the tubular body, the attachment part being disposed laterally to the tubular body whereby externally on the tubular body a cavity is arranged delimited at least partially by the attachment part and the cavity extends in a circumferential direction of the tubular body over less than 360°, the attachment part adding rigidity to the tubular body and comprising a shell body produced from one piece, the shell body, transversely to a longitudinal extent of the tubular body, has a U-shaped cross-section with two legs connected via a curved portion, the legs being fastened on opposite sides of the tubular body, the tubular body being perforated with a perforation in the region of the attachment part, the attachment part comprises a further tubular body produced from one piece, the further tubular body having a connection portion shaped complementary to an outer wall of the tubular body carrying exhaust gas, to which the further tubular body is connected so that the connection portion and the outer wall lie in a planar contact against one another, the connection portion extending from a respective one of the legs in opposite circumferential directions of the tubular body.

2. A pipe according to claim 1, wherein the cavity is closed to an exterior of the exhaust gas carrying pipe.

3. A pipe according to claim 2, wherein the cavity is at least one of fluidically and acoustically connected to an interior of the tubular body.

4. A pipe according to claim 2, further comprising sound-absorbing material wherein the cavity is at least partially filled with the sound-absorbing material.

5. A pipe according to claim 1, wherein:

the attachment part is fastened on the tubular body on two sides of the tubular body facing away from one another;

the attachment part is fastened on the tubular body on the respective sides of the tubular body by a weld connection; and the weld connection extends in a longitudinal extent of the tubular body along the tubular body.

6. A pipe according to claim 1, wherein the connection portion and the outer wall are perforated in the region of the contact between the connection portion and the outer wall.

7. A pipe according to claim 1, wherein the perforation of the tubular body comprises a plurality of openings, which are adjacent to one another at least one of axially and in a circumferential direction of the tubular body.

8. A pipe according to claim 1, further comprising closure elements wherein the cavity is closed in a longitudinal extent of the tubular body at each end by a respective one of the closure elements.

9. A pipe according to claim 8, wherein at least one of:

at least one of the closure elements is fastened on the tubular body; and at least one of the closure elements is fastened on the attachment part or is formed integrally therewith.

10. A pipe according to claim 1, further comprising another attachment part separate with respect to the tubular body, wherein:

the tubular body extends in a straight line; and the attachment part and the other attachment part are connected to the tubular body so as to be arranged at least one of in a circumferential direction of the tubular body and in a longitudinal direction of the tubular body and offset with respect to one another on the tubular body.

11. A pipe according to claim 1, wherein:

the tubular body extends in a curved shape with a curve;

the attachment part is arranged on an inner side of the curve;

the attachment part is shaped so that the cavity, in a longitudinal extent of the tubular body is closed at each end by the tubular body itself;

the attachment part comprises a shell body produced from one piece, which transversely to a longitudinal extent of the tubular body has a U-shaped cross section with two legs connected via a curve, which legs are fastened at opposite sides of the tubular body; and the two legs, at leg edges remote from the curve of the shell body, are curved in accordance with the curve of the tubular body.

12. An exhaust system according to claim 1, further comprising:

an other attachment part separate with respect to the tubular body, the leg of the attachment part and a leg of the other attachment part are fastened on the tubular body by a single weld connection.

13. An exhaust system of an internal combustion engine, the exhaust system comprising:

at least one exhaust gas aftertreatment device with an inlet side and with an outlet side;

pipe sections carrying exhaust gas, the at least one exhaust gas aftertreatment device inlet side being connected to one of the pipe sections and the at least one exhaust gas aftertreatment device outlet side being connected to another of the pipe sections, wherein at least one of the pipe sections comprises:

a tubular body carrying exhaust gas; and an attachment part separate with respect to the tubular body, the attachment part being connected to the tubular body and disposed laterally to the tubular body whereby externally on the tubular body a cavity is arranged delimited at least partially by the attachment part and the cavity extends in a circumferential direction of the tubular body over less than 360°, the attachment part adding rigidity to the tubular body and comprising a shell body produced from one piece, the shell body, transversely to a longitudinal extent of the tubular body, has a U-shaped cross-section with two legs connected via a curved portion, the legs being fastened on opposite sides of the tubular body, the tubular body being perforated with a perforation in the region of the attachment part, the attachment part comprises a further tubular body produced from one piece, the further tubular body having a connection portion shaped complementary to an outer wall of the tubular body carrying exhaust gas, to which the further tubular body is connected so that the connection portion and the outer wall lie in a planar contact against one another, the connection portion extending from a respective one of the legs in opposite circumferential directions of the tubular body.

14. An exhaust system according to claim 13, further comprising sound-absorbing material, wherein:

the cavity is closed to an exterior of the exhaust gas carrying pipe;

the cavity is at least one of fluidically and acoustically connected to an interior of the tubular body; and the cavity is at least partially filled with the sound-absorbing material.

15. An exhaust system according to one of claim 13, wherein:

the attachment part is fastened on the tubular body on the respective sides of the tubular body by a weld connection; and the weld connection extends in a longitudinal extent of the tubular body along the tubular body;

the connection side and the outer wall are perforated in the region of the contact between the connection side and the outer wall.

16. An exhaust system according to claim 13, further comprising another attachment part separate with respect to the tubular body, wherein:

the tubular body extends in a straight line;

the attachment part and the other attachment part are connected to the tubular body so as to be arranged at least one of in a circumferential direction of the tubular body and in a longitudinal direction of the tubular body and offset with respect to one another on the tubular body.

17. An exhaust system according to claim 13, wherein:

the tubular body extends in a curved shape with a curve;

the attachment part is arranged on an inner side of the curve;

the attachment part is shaped so that the cavity, in a longitudinal extent of the tubular body is closed at each end by the tubular body itself;

the attachment part comprises a shell body produced from one piece, which transversely to a longitudinal extent of the tubular body has a U-shaped cross section with two legs connected via a curve, which legs are fastened at opposite sides of the tubular body; and the two legs, at leg edges remote from the curve of the shell body, are curved in accordance with the curve of the tubular body.

* * * * *